United States Patent [19]

Crane

[11] 4,211,358

[45] Jul. 8, 1980

[54] LUG BOX HAVING CORED-OUT PLASTIC END WALLS

[75] Inventor: Walton B. Crane, Sherman Oaks, Calif.

[73] Assignee: Industrial Designs and Services, Encino, Calif.

[21] Appl. No.: 2,295

[22] Filed: Jan. 10, 1979

Related U.S. Application Data

[63] Continuation-in-part of Ser. No. 836,612, Sep. 26, 1977, Pat. No. 4,147,289.

[51] Int. Cl.[2] ..... B65D 5/02; B65D 85/34

[52] U.S. Cl. ..... 229/23 C; 206/523

[58] Field of Search ..... 229/23 R; 206/523

[56] References Cited

U.S. PATENT DOCUMENTS

| | | | |
|---|---|---|---|
| 3,845,861 | 11/1974 | Fieri | 206/523 |
| 3,878,980 | 4/1975 | Crane | 229/34 R |
| 3,915,372 | 10/1975 | Crane | 229/23 R |
| 3,935,990 | 2/1976 | Crane | 229/23 R X |
| 4,102,485 | 7/1978 | Johnsson | 229/23 R |
| 4,147,289 | 4/1979 | Crane | 229/23 R |

*Primary Examiner*—Davis T. Moorhead

*Attorney, Agent, or Firm*—Fulwider, Patton

[57] ABSTRACT

A lug box having cored-out plastic end walls and a wrapper, preferably of corrugated paperboard, that is nailed to the end walls. The wrapper is formed by a single piece including bottom and side panels as well as foldably attached lid flaps that provide a top for the box. Each end wall has parallel ribs extending along its bottom and side edges that receive the nails. Reinforcing ribs in the center sections of the end walls lend added rigidity and strength.

19 Claims, 5 Drawing Figures

LUG BOX HAVING CORED-OUT PLASTIC END WALLS

CROSS-REFERENCE TO RELATED APPLICATIONS

This is a continuation-in-part of allowed application Ser. No. 836,612 now U.S. Pat. No. 4,147,289, dated Apr. 3, 1979 entitled PRODUCE LUG BOX WITH CORED-OUT PLASTIC END WALLS OVERLAPPED BY SIDE AND BOTTOM BODY WRAPPER and filed on Sept. 26, 1977.

BACKGROUND OF THE INVENTION

The present invention relates to lug boxes for produce and the like and, more particularly, to lug boxes that have plastic end walls.

Produce, such as peaches and other tree fruit, tomatoes, and grapes, is commonly packed for handling, shipping and storage in containers referred to as lug boxes or trays. These lug boxes must adequately protect the produce and must have sufficient strength to be stacked vertically. In addition, they must be lightweight and use space efficiently. Because they are generally consumed in large numbers, being used only once, it is of great importance that the cost of the boxes be reduced to the greatest extent possible.

At one time, most lug boxes were made of wood but this type of box has been largely abandoned due to its high cost and weight. More modern lug boxes are often constructed of corrugated paperboard. To give the boxes sufficient strength, particularly for stacking purposes, plastic end pieces are sometimes included, as exemplified by my previously issued U.S. Pat. Nos. 3,878,980 and 3,915,372. In general, a complete four-sided paperboard box is formed which interlocks with the plastic ends.

Other currently used boxes have end walls made of wood to which corrugated wrappers are nailed, but considerable cost is attributable to blocks of wood large enough to receive nails on their edges. Moreover, these boxes require that nails be used to hold the cover in a closed position and it is, therefore, necessary to have a separate second nailing operation to accomplish this purpose.

An objective of the present invention is to provide an improved paperboard and plastic lug box in which cost is reduced without sacrificing strength. Other objectives are to provide an easily assembled lug box that requires a minimum quantity of materials.

SUMMARY OF THE INVENTION

According to the present invention, a pair of plastic end walls form opposite ends of a lug box and a sheet-like wrapper, preferably of corrugated paperboard, is secured to the end walls by nails. Each end wall is cored-out to reduce its cost and weight and is provided with spaced-apart nail-receiving ribs on the sides and bottom.

Preferably, each end wall is rectangular having top, bottom and side edges with horizontal nailing ribs extending along its bottom edge and vertical nailing ribs extending along its side edges. An advantageous end wall construction is about 75 to 80 percent cored-out having a center section partially bounded by the nailing ribs and provided with diagonal reinforcing ribs. Spacer ribs are also provided to separate the nailing ribs.

A preferred wrapper of one-piece construction has a bottom panel that extends between and overlaps the bottom edges, side panels that extend between and overlap the side edges, and lid flaps that depend from the side panels. The flaps can be provided with tabs projecting from their opposite ends to be received and retained by pockets in the end walls, thereby holding the flaps in closed positions.

Other features and advantages of the present invention will become apparent from the following detailed description, taken in conjunction with the accompanying drawings, which illustrate, by way of example, the principals of the invention.

DESCRIPTION OF THE PREFERRED EMBODIMENT

Figure 1:
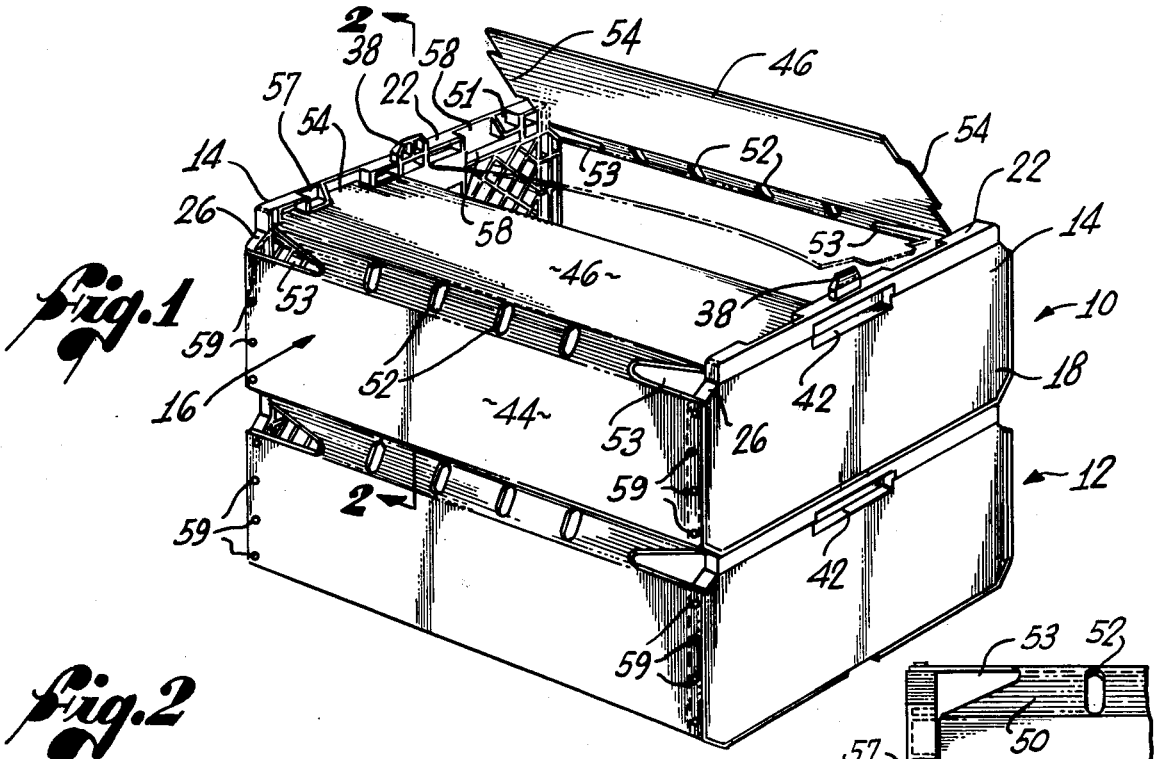
FIG. 1 is a perspective view of two stacked lug boxes each constructed in accordance with the present invention, one of the lid flaps of the upper box being shown in an open position.

Two similar lug boxes 10 and 12, shown in stacked relation in FIG. 1 of the accompanying drawings, are each constructed in accordance with the present invention. In general, each box 10, 12 includes two plastic end walls 14 and a corrugated paperboard wrapper 16.

Figure 2:
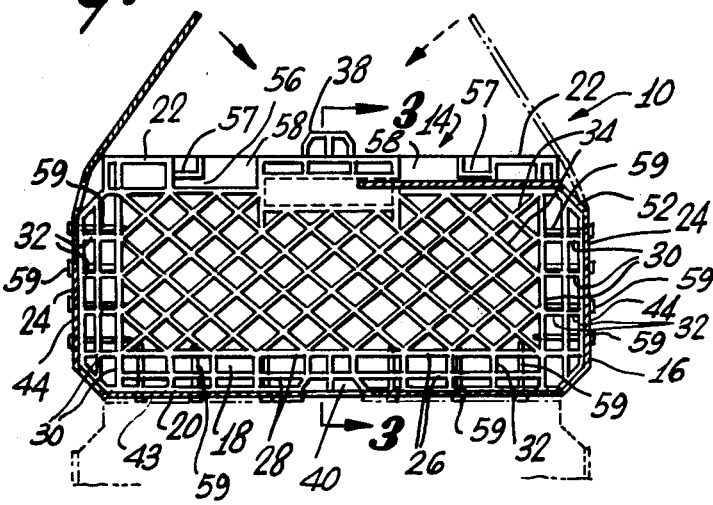
FIG. 2 is an enlarged, cross-sectional view of the upper lug box taken along the line 2—2 of FIG. 1, a fragmentary portion of the lower box being shown in phantom lines.

Referring to the upper box 10 with respect to the following discussion of its construction, the end walls 14 (best shown in FIG. 2) are integrally molded of thermosetting plastic and have a cored-out configuration. Each wall 14 consists of a thin flat end panel 18 that forms the exposed end of the box 10 and narrow, perpendicular flange-like edges that extend inwardly from the end panel. There is a bottom edge 20, a top edge 22, and two side edges 24. At the corners of the end walls 14, the edges 20, 22 and 24 are joined by relatively short shoulders 26 set at 45 degree angles.

Disposed along the bottom edge 20 are a set of spaced-apart, parallel, horizontal nailing ribs 28 that project inwardly from the end panel 18 toward the center of the box 10. Along the side edges 24 are similar sets of vertical nailing ribs 30. The nailing ribs 28 and 30 form thin, flat, plastic strips, the separation between them being maintained by short, perpendicular spacer ribs 32.

A center section of each end wall 14, bounded on the bottom and sides of the nailing ribs 28 and 30, includes a plurality of intersecting diagonal reinforcing ribs 34 that depend from the end panel 18. The reinforcing ribs 34 give added strength and rigidity to the end walls 14 which contain a minimum quantity of plastic in relation to their size and the expected loads. It has been found that end walls 14 cored-out to the extent of 75 to 80% of their overall volume are advantageous. The spaces between the reinforcing ribs 34 are relatively large compared to the higher density of plastic in the areas of the nailing ribs 28 and 30.

Figure 3:
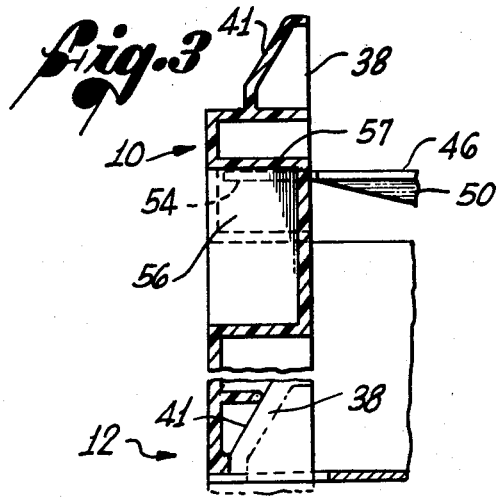
FIG. 3 is a fragmentary, cross-sectional view taken along the line 3—3 of FIG. 2 and showing one end wall of the lug box.

Centered on the top edge 22 of each end wall 14 is an upstanding prong 38 integrally formed with the rest of the wall. Directly below each prong 38 on the bottom of the wall 14 is a recess 40 (shown in FIGS. 2 and 3) shaped and dimensioned to receive the prong of the box 12 below when the boxes 10 and 12 are stacked (as best shown in FIG. 3). The bottom edge 20 of the upper box 10 thus rests on the top edge 22 of the lower box 12 with the prongs 38 and recesses 40 interlocked to prevent relative movement. Inwardly sloping outer surfaces 41 on the prongs 38 help to guide the boxes 10 and 12 into their proper interlocking relationship. The weight of boxes above is borne by the plastic end walls 14 so that the wrapper 16 need only hold the contents of an individual box. On the outside of each end wall 14 near the top is a horizontally elongated finger grip recess 42 by which the boxes 10 and 11 can be carried.

Figure 4:
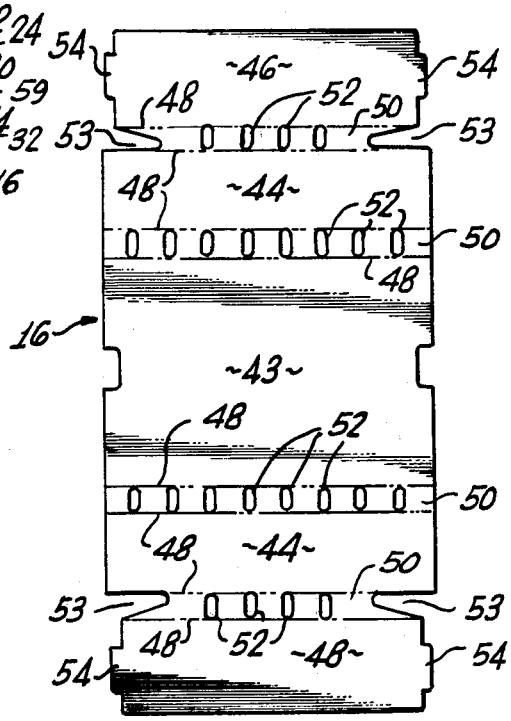
FIG. 4 is a plan view, on a reduced scale, of an unfolded blank that forms the wrapper for the lug box of FIG. 1.

The wrapper 16 includes a large rectangular bottom panel 43 that extends between and overlaps the bottom edges 20 of the end walls 14. Two side panels 44 that depend from opposite edges of the bottom panel extend between and overlap the side edges 24 of the end walls 14, and two lid flaps 46 each depend from one of the side panels. The blank that forms the wrapper 16 (shown separately in FIG. 4) is divided by preformed score lines 48 to define the various panels 43 and 44 and flaps 46 when the box 10 is assembled. These score lines 48 connect points on opposite end walls 14 where the shoulders 26 intersect the edges 20, 22 and 24. Since there are two parallel score lines 48 that separate each pair of adjacent panels 43 and 44 or flaps 46, narrow bevel strips 50 that form 45 degree angles with the bottom and side panels 43 and 44 extend along the corners of the box 10. Each bevel strip 50 is interrupted at short intervals by oblong vent holes 52.

Figure 5:
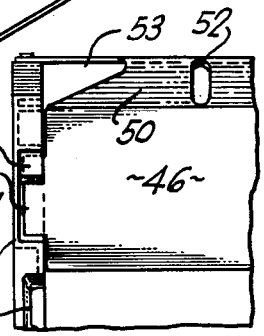
FIG. 5 is an enlarged, fragmentary, top view of one corner of the lug box showing a portion of one lid flap in its closed position.

Deep, generally V-shaped notches 53 separate the outer ends of the flaps 46 from the adjacent portions of the side panels 43. At the opposite ends of each lid flap 46 are tabs 54 that are received by inwardly facing pockets 56 in the top edges 22 of the corresponding end walls 14, as shown in phantom lines in FIGS. 3 and 5. A portion of the top 57 of each pocket near the center of the box 10 is cut away to form a slot 58 that facilitates the insertion of the corresponding tabs 54.

To close the box 10, each flap 46 is folded down from its open position. Simultaneously, it is caused to bow and the end portions of the flap 46 separated by the notches 53 are bent away from the side panels 43 so that the tabs 54 can be inserted through the slots 58 into the pockets 56, as shown in phantom lines in FIG. 1. When the flap 46 is allowed to spring back to a flat position, the tabs 54 are firmly held by the pockets 56 to keep the flap 46 closed, even if it is pushed upwardly by the contents of the box 10. The tabs 54 can be removed from the pockets 56 by flexing the flaps 46 in a similar manner.

It should be noted that the blank required for the wrapper 16 is unusually simple, having only a few cutouts that are not intricate. The score lines are straight, parallel and few in number. A particularly important point to be noted about the blank is that it is of a minimum size since it is not folded over to embrace and interlock with the plastic end walls 14.

The difficult problem of securing the wrapper 16 to the end walls 14 is overcome by the use of nails 59, despite the fact that the box 10 contains no wood or other material with which nails are customarily used. The nails 59 are driven perpendicularly through the overlapping portions of the wrapper 16, through the edges 20 and 24, and into the nailing ribs 28 and 30.

Each nailing rib 28, 30 holds the nails 59 tightly since the plastic is relatively hard. Nevertheless, the end walls 14 do not offer too much resistance to the nails 59 because of the relatively large spaces between the nailing ribs 28 and 30. The spaces also permit flexing of the plastic to prevent splitting. The nails 59 can be closely spaced to prevent separation of any portion of the wrapper 16 from the end walls 14. Since the end walls 18 are plastic, the pockets 56 and the recess 42 can be molded in without significant added cost.

It will be appreciated that the present invention provides a lug box of improved strength and rigidity but characterized by simplicity and low cost. It is easily assembled, makes maximum use of space, and requires a minimum quantity of materials.

While particular forms of the invention have been illustrated and described, it will also be apparent that various modifications can be made without departing from the spirit or scope of the invention.

I claim:

1. A lug box for holding produce and the like comprising:

a pair of parallel end walls defining opposite ends of said box, each of said end walls being generally rectangular and cored-out, having top, bottom and side edges, at least one horizontal nailing rib adjacent said bottom edge and at least one vertical nailing rib adjacent each of said side edges;

a wrapper having a bottom panel extending between and overlappng said bottom edges, a pair of side panels extending between and overlapping said side edges, and at least one lid flap extending between said top edges; and a plurality of nails driven through said wrapper into said ribs to secure said wrapper to said end walls, said nails being substantially perpendicular to at least some of said nailing ribs.

2. A lug box for holding produce and the like comprising:

a pair of parallel end walls defining opposite ends of said box, each of said end walls being generally rectangular and cored-out, having top, bottom and side edges, at least one horizontal nailing rib adjacent said bottom edge and at least one vertical nailing rib adjacent each of said side edges;

a wrapper having a bottom panel extending between and overlapping said bottom edges, a pair of side panels extending between and overlapping said side edges, and a pair of lid flaps foldably joined to said side panels, said lid flaps having closed positions in which they extend between said top edges; and a plurality of nails driven through said wrapper into said ribs to secure said wrapper to said end walls, said nails being substantially perpendicular to at least some of said nailing ribs.

3. The lug box of claim 2 further comprising means for holding said lid flaps in said closed positions.

4. The lug box of claim 2 wherein:

each of said lid flaps has a tab projecting from each end thereof; and each of said end walls defines pockets along the top edge thereof, each pocket being positioned to receive and retain one of said tabs when said lid flaps are in said closed positions.

5. The lug box of claim 2 wherein said wrapper is a single integrally formed sheet of material.

6. The lug box of claim 2 wherein said wrapper is a single sheet of corrugated paperboard.

7. The lug box of claim 2 wherein:

said wrapper is a single integrally formed sheet of material and each of said lid flaps has an integral tab projecting from each end thereof; and each of said end walls defines at least one pocket positioned to receive and retain one of said tabs when said lid flaps are in said closed positions.

8. The lug box of claim 2 wherein:

each of said lid flaps has a tab projecting from each end thereof; and said end walls define pockets positioned to receive a corresponding one of said tabs, each of said pockets having slots in the top thereof through which said corresponding tab can be inserted and removed.

9. The lug box of claim 8 wherein said wrapper is integrally formed of a single sheet of corrugated paperboard.

10. The lug box of claim 8 wherein said wrapper defines notches separating said side panels from said lid flaps at the ends thereof, thereby facilitating the bending of said lid flaps to insert said tabs in said pockets.

11. The lug box of claim 2 further comprising means for interlocking a plurality of such boxes in a stacked relationship.

12. The lug box of claim 2 wherein said end walls are approximately 75 to 80 percent cored out.

13. The lug box of claim 2 wherein said end walls have angled shoulders joining said edges thereof.

14. The lug box of claim 2 wherein:

said end walls have angled shoulders joining said edges thereof; and said wrapper is a single integrally formed sheet of material folded along score lines that correspond to the intersection of said shoulders with said edges.

15. The lug box of claim 2 wherein each of said end walls has a center section bounded at its bottom and on its sides by said nailing ribs, said center section having a plurality of intersecting diagonal reinforcing ribs.

16. The lug box of claim 2 wherein said nailing ribs are arranged in sets of at least two extending along said bottom and side edges, the ribs of each of said sets being parallel to each other.

17. The lug box of claim 16 further comprising a plurality of spacer ribs by which said nailing ribs of each set are separated from each other.

18. A lug box for holding produce and the like comprising:

a pair of parallel end walls defining opposite ends of said box, each of said end walls being generally rectangular, approximately 75 to 80 percent cored-out, having top, bottom and side edges, four shoulders joining said edges, a plurality of horizontal nailing ribs adjacent said bottom edge, a plurality of spacer ribs by which said horizontal nailing ribs are separated from each other, a plurality of vertical nailing ribs adjacent said side edges, and a plurality of spacer ribs by which said vertical nailing ribs are separated from each other;

a center section bounded on its bottom and its sides by said nailing ribs, and a plurality of intersecting diagonal reinforcing ribs within said center section;

a wrapper formed by a single integrally formed sheet of corrugated paperboard having a bottom panel extending between and overlapping said bottom edges, a pair of side panels extending between and overlapping said side edges, a pair of lid flaps depending from said side panels and having closed positions in which they extend between said top edges, and a plurality of tabs extending from said lid flaps, said wrapper being folded along score lines that correspond to the intersection of said shoulders with said edges;

a plurality of pockets defined by said end walls positioned to receive and retain said tabs when said lid flaps are in said closed positions; and a plurality of nails driven through said wrapper into said nailing ribs to secure said wrapper to said end walls, said nails being substantially perpendicular to at least some of said nailing ribs.

19. A lug box for holding produce and the like comprising:

a pair of parallel end walls defining opposite end of said box, each of said end walls being generally rectangular, having top, bottom and side edges, at least one horizontal nailing rib adjacent said bottom edge, at least one vertical nailing rib adjacent each of said side edges, and a plurality of intersecting diagonal reinforcing ribs defining a center section thereof, said end walls being about 75 to 80 percent cored out to leave open spaces bounded by said edges, nailing ribs and, reinforcing ribs;

a one piece wrapper having a bottom panel extending between an overlapping said bottom edges, a pair of side panels extending between and overlapping said side edges, a pair of lid flaps having closed positions in which they extend between said top edges, and a plurality of tabs projecting from said lid flaps;

a plurality of nails driven through said wrapper into said nailing ribs to secure said wrapper to said end walls; and a plurality of pockets defined by said end walls positioned to receive said tabs when said lid flaps are in said closed positions.

* * * * *